US005892205A

United States Patent [19]

Wilde et al.

[11] Patent Number: 5,892,205

[45] Date of Patent: Apr. 6, 1999

[54] HEATER

[75] Inventors: Eugen Wilde, Knittlingen-Freudenstein; Hans Mohr, Sulzfeld; Martin Gross, Kaempfelbach, all of Germany

[73] Assignee: E.G.O. Elektro-Gerate Blanc und Fischer GmbH & Co. KG, Oberderdingen, Germany

[21] Appl. No.: 648,360

[22] Filed: May 14, 1996

[30] Foreign Application Priority Data

May 17, 1995 [DE] Germany ..... 195 18 109.3

[51] Int. Cl.[6] ..... H05B 3/68

[52] U.S. Cl. ..... 219/463; 219/464; 219/467

[58] Field of Search ..... 219/463, 464, 219/465, 466, 467, 468, 541, 542, 544, 552, 553; 338/240, 241, 322, 323, 324, 326, 328, 329, 330, 332, 333

[56] References Cited

U.S. PATENT DOCUMENTS

| | | | |
|---|---|---|---|
| 600,057 | 3/1898 | Ball | 219/464 |
| 3,883,719 | 5/1975 | Hurko | 219/464 |
| 3,984,615 | 10/1976 | Beck | 219/542 |
| 4,161,648 | 7/1979 | Goessler | 219/464 |
| 4,864,105 | 9/1989 | Morgan et al. | 219/468 |
| 4,931,621 | 6/1990 | Goessler | 219/467 |
| 5,393,958 | 2/1995 | Gross et al. | 219/467 |
| 5,477,031 | 12/1995 | McWilliams | 219/468 |
| 5,498,853 | 3/1996 | Gross et al. | 219/463 |

FOREIGN PATENT DOCUMENTS

| | | |
|---|---|---|
| 2642602 | 3/1990 | France . |
| 9305245 | 4/1993 | Germany . |

*Primary Examiner*—Teresa J. Walberg
*Assistant Examiner*—Sam Paik
*Attorney, Agent, or Firm*—Quarles & Brady

[57] ABSTRACT

Connecting conductors located within at least one heating field for heating conductors are configured so that they do not luminate in operation and are not bowed or shifted out of place by thermal loading. For this purpose the conductor is corrugated and also securely anchored at regular center-spacings, it having with respect to the heating resistor greater resistance cross-sections. This achieves for a very simple construction an optically advantageous glow pattern of the heater in every operating mode.

31 Claims, 4 Drawing Sheets

HEATER

BACKGROUND OF THE INVENTION

The invention relates to a radiant heater comprising within an extremely free periphery of a supporting base body of insulating material and/or metal a single or several heating fields. The latter may be located alongside and/or within each other at right angles to a center axis of the base body so that an outer heating field annularly surrounds an inner one partly or totally. Each heating field is assigned heating means such as a heating resistor or heating conductor which in operation thermally radiates in the direction of the front or upper side of the heater, usually through a cover which is permeable to the radiation or translucent, against the rear side of which the base body is in contact by one or more facing surfaces under compressive stress.

Each heating conductor may be disposed as a profile free of contact with the cover or at least partly exposed spaced away from the front side of the base body so that it defines in operation a given visible glow pattern. Connected to its ends and/or spaced between therein each portion of the resistor extending continuously or integrally over the associated length is connected to a connecting conductor, via which the resistor is electrically connected from the outer side of the base body or from a connecting body secured to the latter. This conductor is, like the resistor, not provided with a preassembled sheathing or it is arranged exposed metallically bare on the same front side as the resistor. The connecting wire may be located over its full length within one or more heating fields adjacent to the resistor and may be visible over at least part of this length like the resistor. In this arrangement means are expediently provided which prevent a change in the glow pattern in operation of the connecting wire to the extent that the latter makes no or merely a hardly recognizable contribution to the configuration of the glow pattern. This applies in particular to those portions of the connecting wire which significantly approach from the periphery of a heating field the center thereof, located nearer to a temperature sensor than the resistor arrangement as viewed from the front and/or guided through a heating field or passing near to a heating field into a further heating field. The heating fields are to be operated separately, e.g. so that a central heating field may be operated selectively alone or in combination with an outer defining heating field, to make for one and the same cooking point overall heating fields of differing size available for cooking receptacles of various sizes.

In operation of such a heater the connecting wire is exposed to heating by radiation from the adjacent resistor in each case and thus to alternating elongations which lead to deformations. If the conductor is a straight wire which between its ends is curved only corresponding to the path of the connection, this wire bows in elongation. The conductor becomes all the more deformed, the more it is required to provide a heating output in operation due to an increased inherent resistive value.

OBJECTS OF THE INVENTION

The invention is based on the object of creating a heater in which the disadvantages of known configurations or of the kind described are avoided and which in particular assures highly reliable functioning or high-quality processing in fabrication for a simple arrangement of the connecting conductor in each case which is visually not a disturbance in and/or out of operation. More particularly, the intention is to achieve high operational safety or long useful life.

SUMMARY OF THE INVENTION

According to the invention means are provided selectively or in combination for reducing or avoiding deformations of the connecting conductor at right angles to its main longitudinal direction, by means of which the mechanical load on the connecting points of this conductor are avoided or reduced to such a degree that the connecting points remain locationally stable despite differing thermal loads, by means of which a thermal overload of the conductor in a tightly surrounded or sheathed longitudinal portion is reduced or avoided and/or by means of which glowing of the conductor visible from the front side of the heater is reduced to merely a weakly apparent brightness or avoided. Furthermore, means may be provided to reduce the number of connecting points or connecting conductors, e.g. so that for three heating fields less than six connecting points or connecting conductors and for two heating fields or heating circuits less than five connecting points or connecting conductors are required. Substantially, all of these means may serve to compensate or eliminate thermal expansions of the connecting conductor or the effects thereof.

The conductor is made from strip material which is provided full-length with such a section profile that, as compared to its corresponding cross-sectional extent, it assumes a strip width which is greater, within which the profile alternates at right angles to its main longitudinal direction and which may be constant over the length. The profile configuration may be oriented spirally in two planes or corrugated in one plane only parallel to the front side or the like.

To advantage the connecting conductor features, relative to a length unit of the strip material and/or of the conductor in operation, a lower electrical resistance, a lower temperature and/or a lower glowing brightness than every heating resistor. This may be achieved by a larger material cross-section in one or two of said planes oriented at right angles to each other, a material having a lower specific resistance and/or a more extended profile configuration or greater center-spacing thereof with respect to that of the heating resistor. In case of a corrugation the length of a full corrugation of the connecting conductor is greater than that of a heating resistor so that surfaces of the connecting conductor opposing each other transversely to the main longitudinal direction tend to heat each other up in an inherent increase in temperature of the conductor.

Due to the profile configuration, however, a plurality of juxtaposed conductor sections materializes in the longitudinal direction which are pliantly movable with respect to each other and each of which compensates an associated portion of the thermal expansion with a spacing between the connecting points. As a result of this the connecting points are hardly loaded mechanically and are able to remain in a stable position. Between the connecting points the connecting conductor may be multiply anchored or established in its longitudinal direction directly with respect to the base body. A conductor section located between two anchoring points, comprising several, particularly a maximum of five or ten units of the profile configuration, thus translates its expansions not at all or merely unsubstantially to the sections adjoining its two anchoring ends or to the connecting points located spaced away from these ends. The strip material may feature over the length of the conductor located between the connecting points a constant or alternating cross-section, e.g. an increase in the cross-section or protrusions at the anchoring points which for anchoring engage the base bodies.

The aspect according to the invention is suitable in particular for radiant heaters as set forth in DE-OS 42 29 375 and in DE-OS 42 29 373 to which reference is made in detaining the features and effects included in the present invention. The connecting conductor may be configured, disposed and secured the same as the heating conductor described therein; correspondingly the same applying also to the heating conductor. When both or all conductors, fastener profiles for components or fastener protrusions are made of flat or strip material such as sheet metal a very simple configuration materializes. The strip width of the strip material of the conductors may be equal so that they can be stamped and profiled with the same dies and they can be made from the same material. To reduce the specific resistance it is also possible to make use of the strip material of the heating resistor for the connecting conductor in two layers. To reduce the working temperature the profile center-spacing of the connecting conductor may also be made greater than that of the heating conductor, however, e.g. roughly doubled, by making use of the same corrugated strip for the heating conductor having the closer center-spacing and for the connecting conductor having the extended greater center-spacing. The two conductors may be configured integrally so that for their connection no separate connecting point is needed, this connecting point materializing instead from the transition between two differing center-spacings of the profile configuration.

The connecting conductor can be fitted like the heating conductor and together therewith from the front of the base body, e.g. simply by inserting it into an electrically or thermally effective insulator of an inherently stable, compacted fiberlike and/or grain-like insulant.

At least one heating field or heating circuit may be defined at its inner and/or outer periphery by one surface of the base body oriented transversely to the front side, this surface being provided closed about the periphery or with at least one breakthru. This surface may be formed by one longitudinal side of a web-like protrusion, the other longitudinal side of which screens off the adjacent heating field. Expediently a connecting conductor intersects this screening whereby it may pass through the screening or may be covered by the screening on the front side. Despite this there is no fear of any thermal overload of the conductor in the region of the passing-thru due to the configuration described. The conductor may be closely embedded in the screening or the like and/or pass through a groove-like recess in the screening without coming into contact therewith. If required the screening may also be fitted by snapping it into place or bringing it to grip the front side on the conductor or a corresponding profiled strip, whereby the latter may enter into the recess or penetrate into the material of the screening, thereby piercing a recess or groove shaped correspondingly in the screening. By such means the screening may be additionally locked in position. Two connecting points are then located expediently directly alongside the inside of the screening which may also merely be placed on a front side of the base body. To form the corresponding connecting point the aspects according to the invention may be two to four flat material parts joined to each other in the same plane or parallel thereto and welded together by spot welding. One or two connecting ends of one or two conductors may be located on one or both sides on the flat sides of thicker flat parts and joined thereto with no clearance. The two flat parts may be formed by an integral V or U-shaped clip or the legs thereof. In turn, one of these legs may be configured integral with one of the conductors or with a connecting part passing through the base body from the outside thereof to its inside.

BRIEF DESCRIPTION OF THE DRAWINGS

These and further features are evident not only from the claims but also from the description and the drawings, each of the individual features being achieved solely in itself or in a plurality in the form of subcombinations for one embodiment of the invention and in other areas any may represent advantageous aspects claimable in their own right and for which protection is claimed herein. Example embodiments of the invention will now be detained as illustrated in the drawings in which:

DETAILED DESCRIPTION

Figure 1:
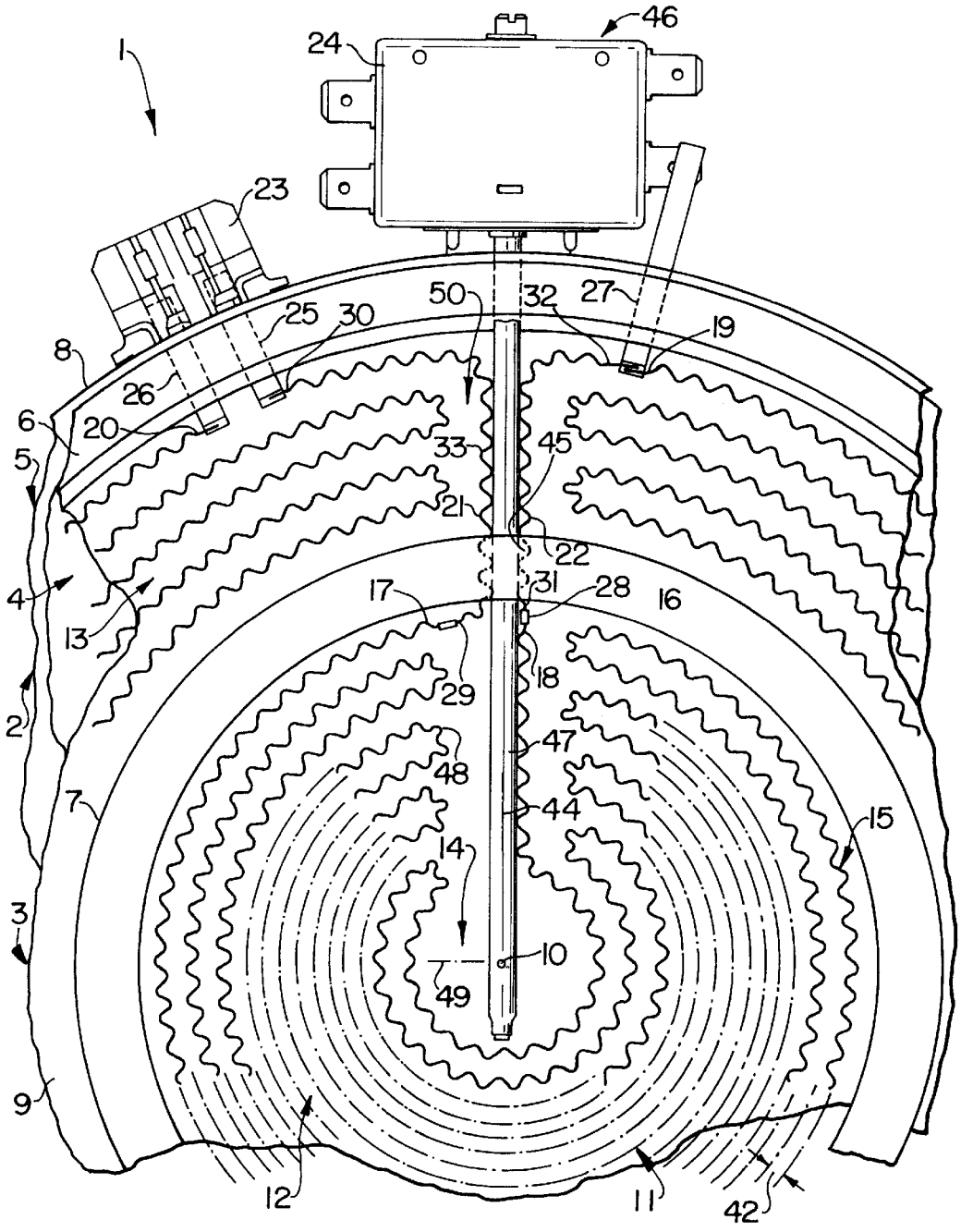
FIG. 1 is a section of a heater according to the invention as viewed from the front.
Figure 6:
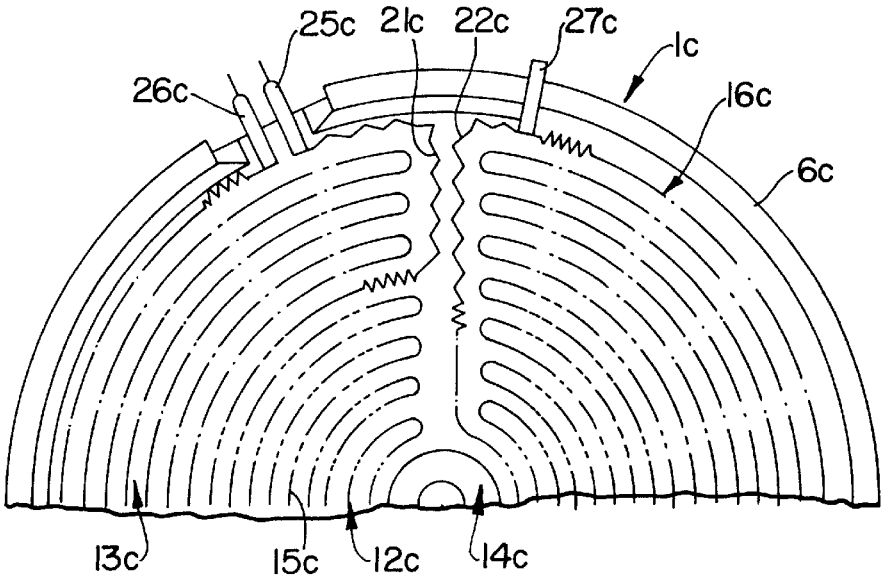
FIG. 6 is a further embodiment illustrated according to FIG. 1 but simplified.
Figure 7:
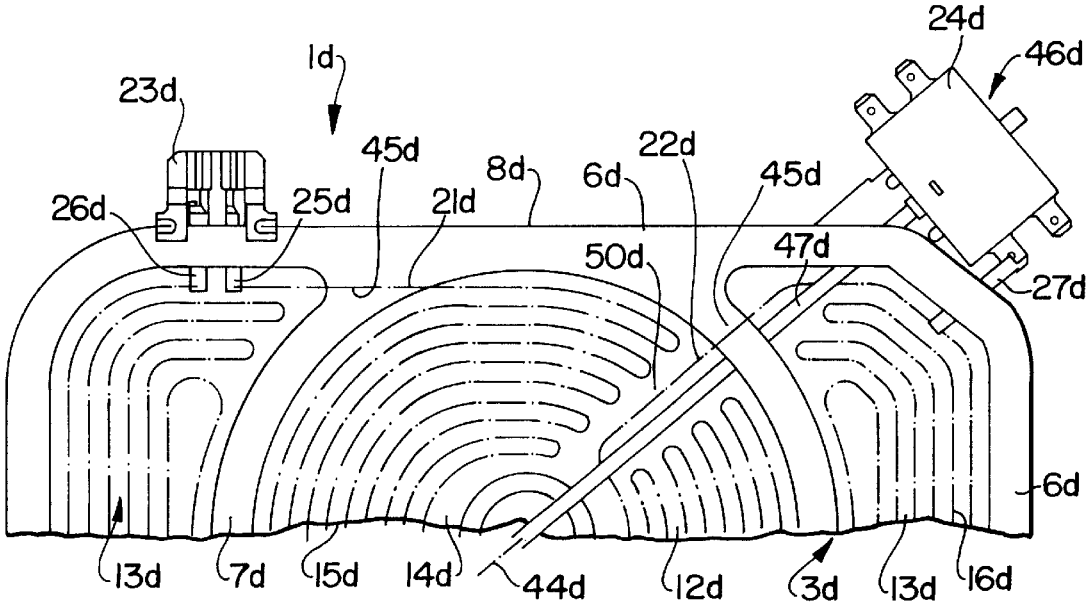
FIG. 7 is a further embodiment illustrated according to FIG. 6.

The heater 1 forms with its illustrated components, means and arrangements a preassembled unit for disposing on the rear side of a vitrified ceramic plate, whereby said unit or vitrified ceramic plate may contain several juxtaposed identical or non-identical heaters e.g. in accordance with the FIGS. 1, 6 and 7. The heater 1 comprises a base body 2 including two thermally and electrically insulating insulating bodies 3, 4 and a carrier body 5 supporting the latter of sheet metal or the like. The insulating body 3 forms a baseplate and two circular defining items, screens or rims 6, 7 concentrically spaced one within the other, of which each may be condigured integrally with or separately from the base plate.

Each insulating component is made expediently of a bulk starting material compacted in a mold e.g. a pyrogenic silicic aerogel compacted with a binder, dry compacted vermiculite and/or a fibrous, mainly ceramic fibrous slurried material which is compacted wet in the mold and then dried. Preferably the base plate consists substantially of the dried compacted granulate of minute globules and/or spar-like particles which may be reinforced by the admixture of the cited fibers. Expediently the rim consists substantially of the vacuum-molded or fibrous material. The base plate may be fully planar on the front side or form a protruding rim base via a partial elevation of the rim 6 or 7 on which the remaining fibrous rim portion is placed in full contact, particularly following arrangement of the conductors on the base plate. At the outer circumference of the base plate and of the outer rim 6 for the support thereof one rim 8 of the supporting body 5 is located which forms the outermost and exposed circumference of the base body 2. This rim 8 is integral with a base plate which supports the insulating base on its outside. Between the base of the supporting body 5 and the insulating base a separate plate-shaped insulating body 4 may be disposed, however, it is preferred that the base plate of the insulating body 3 is integral up to the supporting base so that only a single insulating base is necessary.

The aforementioned components and arrangements 1 to 8 each form a shallow dished body open to the front and defining a center axis 10 at the center thereof. The insulating body 3 inner surface located within or between the rims 6, 7 forms a roughly planar full-length facing or base surface 9 oriented at right angles to the axis 10 which is exposed to the front side of the heater 1. The corresponding face of the rim 6 or 7 projects above the base surface 9 and serves to provide a press-fit and near sealed and pliant contact with the translucent cover plate with respect to which the rim 8 and, where necessary, also the rim 7 may be slightly set back.

The rim 7 defines in its interior a first, central heating field 12 and between the two rims 6, 7 a second ring-shaped heating field 13 is defined. Both heating fields 12, 13 directly adjoin the associated circumferential surfaces of the rims 6, 7. The internal width of the field 13 is greater than its radial extension and the internal width of the ring-shaped field 13 is smaller than its radial extension so that the base 6 about the axis forms a small, non-heated center 14. In field 12 a first profiled strip resistor 15 is arranged having roughly a uniform center-spacing and in field 13 a corresponding second resistor 16. For uniform center-spacing the resistor 15 or 16 may form concentrically ring-shaped, spirally shaped and/or alternating parallel or straight-line sections about the axis 10, in these sections the profiled strip resistor material being again profiled full-length in itself, namely by being curved sinusoidally, trapezoidally or in similar corrugated or equal consistent formations. According to FIG. 2*a* the corrugation comprises semi-elliptical shallow curves and flat legs directly adjoining tangentially full-length thereto.

Both ends 17, 18 of the conductor 15 are located on the outer circumference of the field 12 directly adjacent to the inner cicumferential surface of the rim 7. One end 17 is formed directly by an outer ring section of the conductor 15 and one end 18 by a straight-line section emanating from the innermost ring section radially. Also forming a straight line here is the main longitudinal direction within which the strip material departs from the straight line by its profile. The two opposedly oriented ends 19, 20 of the conductor 16 are formed by their outermost ring sections and are located correspondingly directly adjacent to the inner circumferential surface of the rim 6.

For connecting the ends 17, 18 or the conductor 15 two connecting conductors 21, 22 are provided which are guided from the ends 17, 18 via straight-line sections through the field 13 and then directed away from each other or each directed against one of the ends 20, 19 in keeping with the outermost sections of the conductor 16 along the inside of the rim 6 up to the connecting points in a curved orientation. At the outer circumference of the body 2 and of the rim 8 respectively and totally located spaced between the outermost faces thereof two connecting bodies 23, 24 are secured directly adjacent spaced away from each other, each of which comprises a socket of insulating material, e.g. hard ceramic. From the socket of the smaller body 23 two directly adjacent connector tags 25, 26 emanate and from the socket of body 24 one such connector tag 27 emanates. The conductor tags made of strips of flat material are located radially with respect to axis 10 and pass through the rims 6, 8 from the outside to the inside so that their inner ends are exposed to form the connecting points at the base 9 or at the ends 19, 20 of the conductor 16 or at the associated outer ends 30, 32 of the conductors 21, 22. The inner ends 29, 31 of the conductors 21, 22 are connected via electrically conducting connectors 28 to each end 12 and 18 respectively directly adjacent to the inside of the rim 7. The end 30 is connected only to the tag 25, the end 20 only to the tag 26. Connected to the tag 27 are two ends 19, 32. When only the tags 25, 27 receive an electric potential, only the arrangement 12, 15 is in operation, if only the tags 26, 27 receive the potential only the arrangement 13, 16 is in operation and when all tags 25 to 27 receive potential, both arrangements are in operation.

The radial spacing between the outermost section of the conductor 15 and the innermost section of the conductor 16 or the width of the rim 7 is smaller than the expanse of the field 12 or 13 or 14 so that in operation of both fields a total field 12, 13 is formed which is heated over its full expanse more or less uniformly.

All conductors 15, 16, 21, 22 consist of the same profiled starting material, this being the reason why the description of each conductor applies the same also to every other of these conductors. Merely the conductors 21, 22 consist of a strip material which is somewhat larger or twice as thick as that of the conductors 15, 16, they otherwise being the same or similar thereto as regards material, profiling, securing, height, location with respect to the plane of surface 9 and the nature of the connection to tags 25 to 27. At least one of the conductors 15, 16, 21, 22 may however also be consistently shaped or bent spirally over its length partly or completely.

Figures 2, 2A:
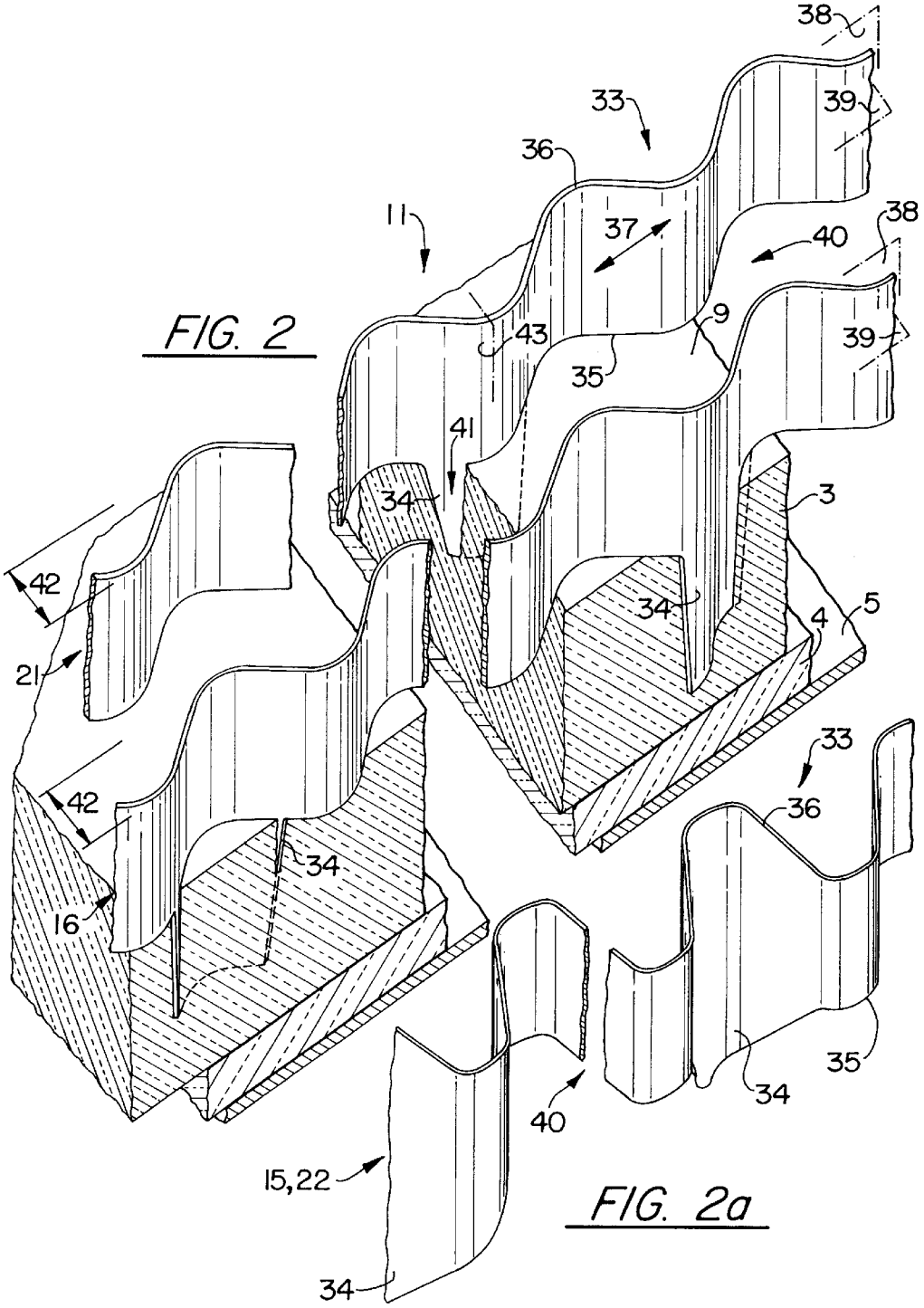
FIG. 2 is a section of the heater in FIG. 1 illustrated in a sectioned perspective.
FIG. 2*a* is a further profiled aspect having a trapezoidal corrugation.

As particularly evident from FIGS. 2 and 2*a* the conductor 16, 21 and 51, 22 respectively comprises anchors 34 protruding at right angles to the base 9 which integrally connect the longitudinal edge 35 of the base 9 and are curved in keeping with this edge 35 only when viewed from the front side 11. These anchors 34 are equally distributed over the length of the conductor, extend at the most over a full corrugation and have intermediate spacings which lie between a full corrugation and a maximum of four full corrugations, particularly roughly one to four full corrugations. As a result each anchor 34 is curved spadelike in keeping with the associated longitudinal sections of the longitudinal edges 35, 36 oriented parallel to each other only when viewed from the front side 11, but protrudes above the longitudinal edge 35 by at least the spacing between the edges 35, 36 or further and forms in each case at least one convex flank each and directly on the other side one concave surface which is provided full length without interruption over its height or that of the conductor 16, 21. Depending in which corrugation section the anchor 34 is located, it may be curved merely plainly, S-shaped or similar or located on the one and/or other side of the longitudinal center plane of the conductor profile. The center-spacing of the anchors 34 differs from that of the profile configuration so that adjacent anchors feature shapes and positions different to those of the longitudinal center plane 38 which they intersect.

In FIG. 2 the front sectional plane of the bodies 3 to 5 is located in the center plane 38 of the conductor 16. The conductor 15, 16, 21, 22 is pressed into place in the front side of the dry base 9 transversely to its main longitudinal direction 37 or parallel to the center plane 38 so that all anchors 34 penetrate the base 9 simultaneously in the form of piercing tips tapered in an acute angle, thereby first creating their receiving recesses in the base 9 and then becoming embedded at their flanks with their flanks and side edges in full surface contact. The edge 35 can thereby stop against the base 9 without penetrating, remain gap spaced therefrom and/or partly penetrate into the base like the anchors 34. Also feasible is to widen the strip material of each conductor so that its longitudinal edge 35 is continuous in the plane of the peaks of the then non-existent individual protrusions or passes through a plane and the thus resulting rim strip is embedded full length in the base 9.

The center plane 38 is located parallel to the longitudinal direction 37 and at right angles to the base surface 9 or to the level plane 39 of the conductor 16, 21 which in this case is defined in the middle of the height of the conductor. The edges 35, 36 are located full-length parallel to plane 39 and have the same spacing from each other for all conductors. The longitudinal edges 35 of adjacent conductor sections and/or of all conductors are located just the same in a common level plane as their edges 36. The longitudinal direction 41 of the anchor 34 is located at right angles to the plane 39 amd parallel to the plane 38. Due to this profiling the profile strip width 42 of the conductor 16, 21 materializes which is substantially greater than the material thickness of a few hundredths of a millimeter and in the middle of which the plane 38 is located. Like the other conductors the anchor 34 may in at least one cross-section up to all cross-sections located parallel to the planes 39, 43, pass through without interruption up to the side edges or up to the peak.

By the configuration according to the invention means 40 are provided which prevent a visible glowing of the conductors 21, 22 during operation or a visible glowing of the conductor 15. The conductor 21, 22 could however also be connected such that it visibly glows in operation of both conductors 15, 16 so that such portions of the field 13 which are not occupied by the conductor 16, are then filled visibly glowing by the conductor 21, 22. When viewing the front side 11 the conductor 21, 22 intersects none of the remaining conductors and is nevertheless fully located and like the conductors 15, 16 visible on the front side 11 of the base 9 due to it being shifted as a whole in the heating conductor plane. As a result of this a highly compact construction materializes, particularly as regards the axial coverage of the heater 1.

Between adjacent anchors 34 each single corrugation, full corrugation or every full-length section forms a compensation section 33 which in the fashion of a longitudinal spring absorbs inherently reversible any thermal elongations due to deformation, without this possibly resulting in any appreciable change in the strip width 42. Due to the resilient deformability of the base 9 the anchors 34 are also able to slightly deviate to accommodate elongations without increasing their receiving recesses. The conductor 16, 21 thus forms a plurality of juxtaposed sections 33 over its length, the length of which in keeping with the profile or length center-spacing of maximally 10 and 6 mm respectively and minimally 2 mm is 2 and 3 times greater respectively than the profile strip width 42 at the most. In the full-length condition or in the condition extended in a single plane of the conductor 16, 21 the height of the anchor 34 in each case of e.g. between 2 and 3.5 mm is smaller than its maximum width of e.g. 3.5 to 6.5 mm. The mean spacing between adjacent anchors 34 may thereby amount to 3 to 6 times this largest width of the anchor which is acutely angled or symmetrically trapezoidal full length. The majority of the anchors 34 are configured asymmetrical to their center plane 43 located between their side edges and at right angles to the direction 37 or to the planes 38, 39 and the rim zones forming the side edges are located inclined with respect to the plane 38, 39. The length of a full profile configuration or full corrugation corresponds to two opposed curves and two legs, a full corrugation with its opposing legs being able to extent up to the plane 38. The angle between diverging corrugation legs amounts expediently to a maximum of 120°, 90°, 45°, 40° or 35° in the extended condition of the corrugated strip and the leg opening is at least 1.5 to 2 times or a maximum of 3 and 4 times wider respectively than the bottom of the corrugation. Correspondingly the same applies also to the shape of the anchors 34. The conductor 21, 22 may be heated up by the electrical power applied to it and/or by the sections of the conductor 15 and 16 respectively adjacent to it. In any case the described luminuous suppression 40 is achieved.

The conductors 21, 22 form on both sides of an axial plane 44 of the field 12, 13, 14 and of the axis 10 respectively or of the rim 6, 7 symmetrically located straight strip sections which pass through the rim 7 in the region of a lead-thru 45. For this purpose the rim 7 may feature on the rear side a groove-like recess which receives both conductors 21, 22 so that the latter are closed off covered with respect to the front side. The connectors 28 are located roughly on the curvature bend of the outermost sections of the conductor 15. The innermost curvature section thereof translates into a strip section oriented in a straight line outwardly and forming the end 18 and the straight strip sections of the conductors 15, 22 connect one another in line. The outer strip sections of the conductors 21 or of their arcuate sections are located on the curvature bends of the outermost sections of the conductor 16 and form the ends 30, 32.

In the axial plane 44 the rod-shaped straight or cylindrical temperature sensor 47 of a controller such as a temperature limiter 46 is located, the socket of which receiving the associated switching contacts is formed by that of the body 24. The sensor features two rods having differing temperature expansion coefficients, namely an outer tube and an inner rod located within the latter. One rod, e.g. the outer tube is rigidly secured to the socket and the other actuates the contacts contained in the socket. When the switching temperature is attained the tags 27 as well as both conductors 15, 16 are taken out of circuit. The limiter 46 may further contain a signal contact or the like e.g. for a hot indication of the cooking point. The sensor 47 is located parallel to the plane 39 of the edges 36 and opposite the latter by an axial spacing which is at least as large as the spacing of the edges 36 from the base surface 9, at the most 3 times as large as this spacing and in particular roughly twice as large. The height spacing of the edges 36 is roughly between 1 to 2 times the width 42 and may like the width amount to between at least 2 and not more than 5, particularly between 3 and 4 mm. Correspondingly the same applies also to the extent or diameter of the sensor 47 and the clear spacing between the sections of the conductors 21, 22 located parallel under the sensor 47, the dimension of said sections possibly being between 4 and 5 mm.

The sensor 47 having an outer cross-section which is constant over its full length passes through radially a closely adapted opening or hole in the rim base of the body 3 and/or in the rim 6 as well as a corresponding opening in the rim 7, whereby this latter opening may be as for the conductors 21, 22. The free end of the sensor 47 extends at least or merely up to the field 14 and past the axial plane 49 of the axis 10 at right angles to said field only slightly. In the zone 14 the sensor 47 may be supported with respect to the base surface 9 by a protrusion or the like under compressive stress or transversely to the plane 39 or it may be rigidly mounted by fastening means. In the region of the field 12 or 13 the sensor 47 is located over the full corresponding length of the surface 9 freely with respect to and set back from the face contact of the rim 6 or 7.

Adjacent arcuate sections of the conductor 15 or 16 curved about the axis 10 translate integrally into each other at both ends spaced away adjacently from plane 44 or the straight sections of the conductors 21, 22 and from sensor 47 via close reversals 48 or a bend. All adjacent arcuate sections have over their length equal clear radial spacings from each other and these spacings may be slightly smaller in one field 12 than in the other field 13. All reversals 48 on the corresponding side of the plane 44 define a plane parallel thereto, the spacing of which from the plane 44 is greater than the spacing between the arcuate sections and their clear spacing from the straight-line sections of the conductors 15, 21, 22 equals the spacing between the arcuate sections. As a result of this, when viewing the front side 11 on both sides of the plane 44 a strip-shaped zone 50 is formed located between the defining planes of the reversals 48, this zone having in operation a substantially lower power density than the zone in the region of the arcuate sections of the conductors 15, 16 and in which only the straight strip sections of the conductors 15, 21, 22 as well as the exposed longitudinal sections of the sensor 47 are located. The zone 50 extends via two fields 12, 13 up to zone 14 and is interrupted only by the rim 7 to the extent that it is formed by the surface 9.

As a result of this, in operation of the conductor 15 or 16, the sensor 47 is loaded thermally to a lesser extent than if it were to intersect the more densely powered zones so that it reacts to heating up not too quickly but delayed. In field 12 the sensor 47 is loaded thermally somewhat more heavily, however, than in field 13, due to the straight section of the conductor 15, so that in sole operation of the field 12 and thermal loading of only the associated part of the sensor length overheating of this field 12 is avoided. The innermost arcuate section of the conductor 16 extends integrally on the side of plane 49 facing away from the lead-thru 45 via the plane 44 and all other arcuate sections are connected to each other via reversals 48. All arcuate sections of the conductor 15 on this side of the plane 49 also extend integrally. The reversals 48 of the arcuate sections of the conductor 16 may be located on the side of plane 49 facing away from zone 50 closer to each other than on the other side.

Figures 3, 4, 5:
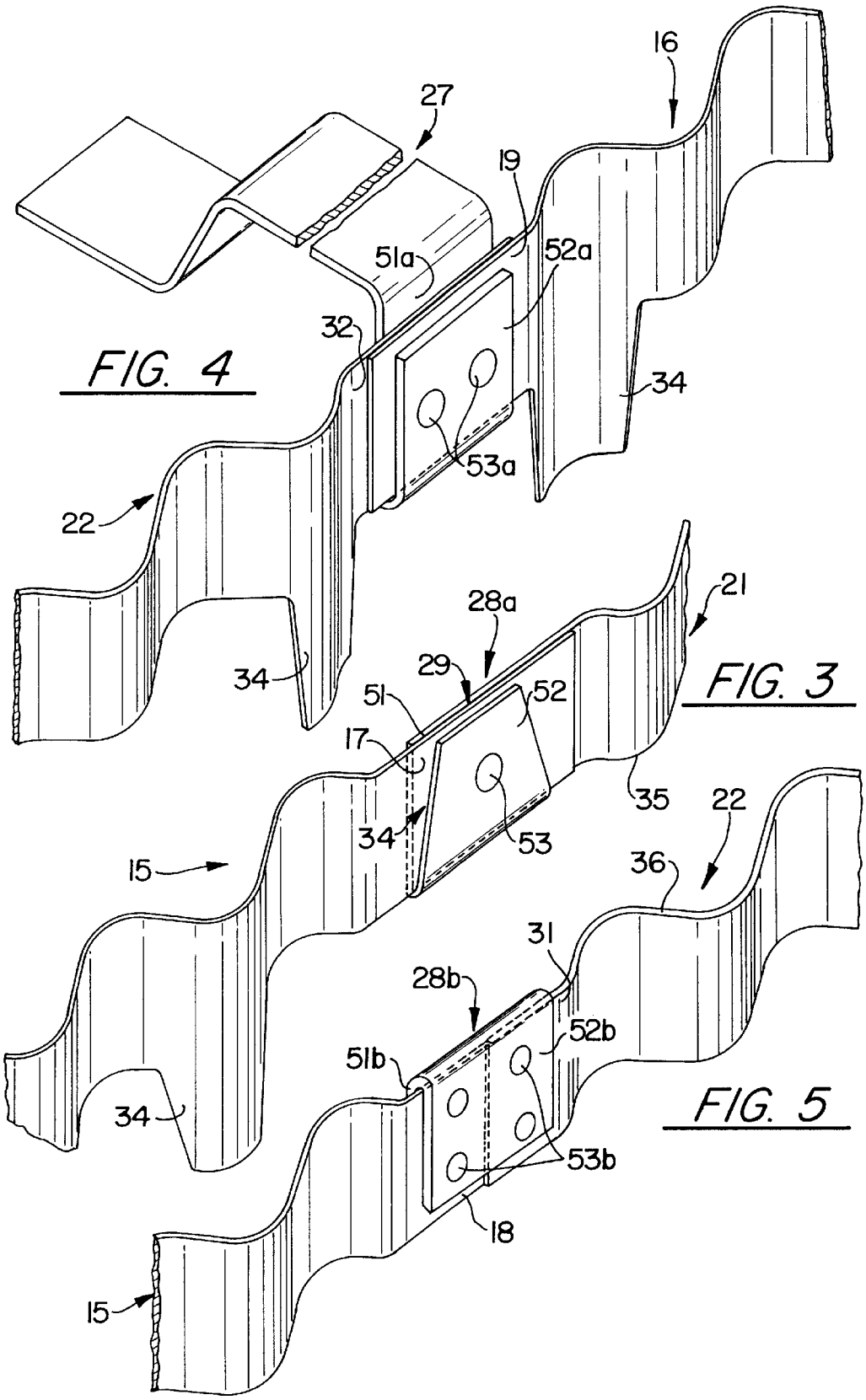
FIG. 3 shows a connecting point between two conductors in a perspective illustration.
FIG. 4 shows a connecting point between two conductors and one connecting point coming from without in a perspective illustration.
FIG. 5 shows a further connecting point between two conductors in a perspective illustration.

The connector 28*a* according to FIG. 3 requires in addition to the conductor 15, 21 no component. To reduce the corrugation height the ends 17, 29 of both conductors 15, 21 are pressed flat or level over one or two corrugation lengths at the most, i.e. one end 29 in the region of an anchor 34 which may adjoin the associated edge edge. This protrusion 34 is folded at 180° or about the edge 35 against the end 29 so that two plate-shaped cheeks 51, 52 are formed which at first are located in an acute v-shaped angle to each other. Between these cheeks 51, 52 the other end 17 may be inserted transversely to plane 39 and/or parallel to the direction 37 so that the two ends 17, 29 are located flat one on the other. The cheeks 51, 52 are pressed against each other and against the end 17 with tongs, such as welding tongs, and all three layers rigidly connected to each other by a fastening member 53, e.g. a welding spot. Even without said fastening member 53 a reliable connection may result, because the ends 17, 29 are resilient with respect to the shape of the profile and the layers 17, 51, 52 are transversely tensioned against each other already thereby. The cheek 52 extends away from the surface 9, but could also being oriented towards the latter. Furthermore, at least one of the layers could directly form an anchor engaging the base 9, whereby this anchor may be flat or curved according to the anchors 34. Directly adjacent to the connector 28*a* spaced away therefrom at least one conductor 15, 21 features an anchor 34 so that mechanical stresses of the connecting point are bound up by thermal strains.

Corresponding conditions apply also to the connector according to FIG. 4 which is provided for the tags 25 to 27 and is explained by way of tag 27. The flat material strip 27 passes through, as explained on the basis of sensor 47, the bodies 2, 3, 5 and forms directly adjacent to the inside of the rim 6 the cheek 51*a* cranked with respect to the base 9, the cheek 52*a* adjoining said cheek to form the receival for the corresponding end 19, 32. The corresponding end 19, 32 may protrude from the cheek concerned in the direction 37 or transversely to the plane 39 or the corresponding cheek may protrude in these directions. This connecting point is located between two near anchors 34. The outer end of the strip 27 is connected to a laterally protruding connection such as a flat insertion blade of the body 24 by welding or the like. The strips 25, 26 engage the socket 23 and are to be connected like connections of the body 24 with external feeders emanating from a manually operatable controller such as a rotary switch. The strip in each case may be inserted from the inside of the rim 6 and then connected with the associated socket or the associated connection by welding, insertion, claw-type action or the like.

Instead of overlapping each other as shown in FIGS. 3 and 4 the ends 18, 31 of the conductors 15, 22 butt smoothly against each other by their end edges as shown in FIG. 5 between which a small gap may also exist. The cheeks 51*b*, 52*b* are formed a separate U-shaped component which instead of being mounted at the edge 36 is mounted from the edge 36 or covers this edge 36 by its cross-web. Both ends 18, 31 are secured by separate fastener members 53 to the electrically conductive cheeks 50*b*, 52*b*. Each of the connecting terminals as shown in FIG. 1 may be formed by each of the connectors as shown in FIGS. 3 to 5.

In the FIGS. 6 and 7 as well as in the FIGS. 3 to 5 like parts are denoted by like reference items as in the other Figures but with differing index letters so that all parts described apply accordingly for all Figures.

In this case the conductors 15*c*, 21*c*, 22*c* or their ends adjoining each other are configured integral throughout of the same strip material so that separate connectors 28 can be dispensed with. In the region of the conductor 15*c* or 16*c* one length unit of the corrugated strip contains at least 1.5 and a maximum of 3 to 4 times the length of strip material, particularly at least 2 times the length. In the region of the conductor 21*c*, 22*c* the length unit thereof may contain almost the length of strip material corresponding to its length. As compared to the conductor 15*c* or 16*c* the length unit of the conductor 21*c*, 22*c* expediently contains merely at least a third and maximally two thirds, particularly half of strip material. This is achieved by an elongation of the corrugation or center-spacing of the corrugation such that the conductor 21*c*, 22*c* has a substantially more shallow corrugation than the conductor 15*c*, 16*c* and its adjacent legs of the corrugation diverge at a greater angle which may be greater than 45°, 60°, 90° or 120°. This also results in the width 42 being reduced almost by half and the spacings between the anchors 34 like the lengths of the full corrugations are increased correspondingly. In operation the heating up of one with respect to the other due to adjacent legs of the corrugation is not as much as in the region of the conductor 15*c*, 16*c*, resulting in the retardation or suppression of the luminosity or glow being achieved. As compared to FIG. 1 two connectors 28 and two separate conductors 21, 22 can thus be dispensed with. In accordance with FIG. 6 no rim 7 is provided between the two fields 12*c*, 13*c*. If such a rim or web is provided no significantly increased temperature of the conductor 21*c*, 22*c* occurs in the region of the lead-thru 45 due to extension of the profile. In FIG. 6 the central ring-shaped protrusion of the base 3 for supporting the sensor 47 (not shown) evident which protrudes less far than the rim 6 or 7.

The heater 1*d* as shown in FIG. 7 is as seen from above elongated rectangular and on both sides of the field 12*d* two separate fields 13*d* are located which in operation with the field 12*d* form an elongated, rectangular overall cooking field. The conductors 16*d* of the fields 13*d* may also be operable separate from each other or only together. Their conductor sections located nearest to the rim 7*d* translate into each other on the side as stated integrally via a connecting conductor extended as shown in FIG. 6 or via a separate connecting conductor having connectors as shown in FIGS. 1 to 5. This conductor is guided through a guide-thru 45 of the rim 7*d* and thus covered. The rim 7*d* integrally connects the longitudinal sides of the rim 6*d*. Parallel to these longitudinal sides the conductor 21*d* passes through a guide-thru 45*d* of the rim 7*d* directly adjacent to the inner side of the rim 6*d*, since the outermost conductor sections of the conductors 15*d*, 16*d* adjacent to this longitudinal side line up with each other. The conductor 22*d* passes through a guide-thru 45*d* located inclined with respect to this longitudinal side and correspondingly located inclined is also the body 24*d*, the regulator 46*d*, the sensor 47*d* and the zone 50*d*. The conductors 15*d*, 16*d*, 21*d*, 22*d* may be configured and connected like those of FIG. 1 in each of the kinds described. The tags 25*d*, 26*d* are located in the one field 13*d* and the tags 27*d* in the other field 13*d* so that in field 12*d* no connecting tag protruding inwards from without and also no associated body 23*d* is needed. The connection of the conductor 15*d* is made exclusively via lead-thrus or passages 45*d* which are located within the outer circumference of the body 3*d* or of the rim 8*d* and directly connect field 12*d* to fields 13*d*.

Depending on the requirements all of the stated properties as well as locations and orientations of the components or arrangements 1 to 53 may be provided precisely as explained, substantially as explained, merely roughly as explained or greatly departing therefrom. All features of all embodiments may be provided advantageously on a sole heater unit. All stated dimensions may be maximum or minimum values.

We claim:

1. A heater for connecting to an external power supply and comprising:

a base body (2) defining an outermost body circumference and a center axis (10) within said body circumference, within said body circumference said base body (2) defining a front side (11), at least one heating field (12, 13) and a field center (14) within at least one of said heating field (12, 13);

a heating source for emitting a heat radiation and including a heating conductor (15, 16), said heating source defining outermost heating sections located closest to said body circumference, said heating source including at least one connecting point (17–20) for connecting said heating source with the power supply, and at least one supply conductor (21, 22) connected with said connecting point (17–20) for supplying said heating source from the power supply, said supply conductor (21, 22) being oblong to define a general conductor length extension (37), in operation said supply conductor (21, 22) being exposed to varying thermal stresses including length extensions and length contractions, with respect to said base body (2) said supply conductor (21, 22) being at least partly located in a conductor plane (39), said supply conductor (21, 22) including remote connecting ends (29–32) and a conductor undulation along said general conductor length extension (37), wherein means (40) are provided for compensating said thermal stresses.

2. The heater according to claim 1, wherein said heating conductor (15, 16) and said supply conductor (21, 22) define operational conductors each including remote power transmitting points including said connecting point (17–20) and said connecting ends (29–32), between said power transmitting points (17–20, 29–32) at least one of said operational conductors (15, 16, 21, 22) including a longitudinally resilient compensation section (33).

3. The heater according to claim 2, wherein at least one of said operational conductors (15, 16, 21, 22) defines an overall conductor length extension, over most of said conductor length extension at least one of said operational conductors (15, 16, 21, 22) being shaped to provide a resilient spring, said operational conductor (15, 16, 21, 22) being made from a line material in cross-section defining at least one line width extension, along said conductor length extension said line material including conductor sections oriented transverse to said conductor length extension, along said conductor length extension said operational conductor (15, 16, 21, 22) thereby extending over a band width (42) larger than at least one of said line width extension.

4. The heater according to claim 2, wherein at a distance between said transmitting points at least one of said compensation section (33) directly adjoins to at least one anchorage (34) fixedly connecting said operational conductor (15, 16, 21, 22) with said base body (2).

5. The heater according to claim 2, wherein said operational conductor (15, 16, 21, 22) is fixed to said base body (2) with separate anchorages (34) spaced with respect to each other, said compensation section (33) including a plurality of chaining compensation sections (33) located between said juxtaposed anchorages (34).

6. The heater according to claim 2, wherein a plurality of said compensation sections (33) is distributed substantially entirely over an overall length extension of said operational conductor (15, 16, 21, 22), said compensation sections (33) including juxtaposed sections (34) directly interconnecting.

7. The heater according to claim 2, wherein said compensation section (33) includes said conductor undulation, said supply conductor (21, 22) being made from a flat band material.

8. The heater according to claim 2, wherein said compensation section (33) of said supply conductor (21, 22) is located at said front side (11) and oriented substantially parallel to said front side (11).

9. The heater according to claim 2, wherein between said power transmitting points (29–32) and along said general conductor length extension (37) said compensation section (33) is directly fixed to said base body (2) at a plurality of separate fixing points, said fixing points (34) being interspaced by substantially regularly repeated point spacings, at at least one of said fixing points (34) said compensation section (33) including a projection (34) directly engaging into said base body (2) substantially without any motion play parallel to said conductor plane (39).

10. The heater according to claim 9, wherein said projection (34) is made in one part with said compensation section (33), in the vicinity of said projection (34) said compensation section (33) defining a cross-section different with respect to a cross-section adjacent to said projection (34).

11. The heater according to claim 1, wherein per length unit said supply conductor (21, 22) defines a heat emission below said heating conductor (15, 16), said supply conductor (21, 22) including at least one protrusion (34) directly embedded in said base body (2), in cross-section parallel to said conductor plane (39) said protrusion (34) including at least one concavely curved side face.

12. The heater according to claim 1, wherein said supply conductor (21, 22) is fixed to said base body (2) with a protrusion (34) made from sheet material.

13. The heater according to claim 1, wherein said supply conductor (21, 22) is pierced into said base body (2) with a piercing tip (34) providing an anchorage for said supply conductor (21, 22).

14. The heater according to claim 2, wherein said supply conductor (21, 22) defines remote first and second length edges, at least two juxtaposed and interspaced separate protrusions (34) projecting over said first length edge, between said protrusions (34) said compensation section (33) being bent to form at least one inherently stiff full corrugation wave.

15. The heater according to claim 1, wherein over substantially entirely said general conductor length extension (37) said supply conductor (21, 22) is substantially continuously and evenly corrugated.

16. The heater according to claim 1, wherein said compensating means (40) include at least one compensation section (33) included in said supply conductor (21, 22), said compensation section (33) being substantially entirely freely exposed at said front side (11) without any tube covering.

17. The heater according to claim 1, wherein said compensation means (40) and said supply conductor (21, 22) include at least one longitudinally resilient compensation section (33), said compensation section (33) and said heating conductor (15, 16) projecting over said front side (11) by substantially a same amount.

18. The heater according to claim 2, wherein said compensation section (33) is located directly adjacent to a plurality of substantially equally oriented heating strands of said heating source when seen in a view against said front side (11).

19. The heater according to claim 2, wherein per length unit at least one of said compensation section (33) defines an electrical resistor value significantly below said heating conductor (15, 16), in operation said compensation section (33) emitting a substantially invisible radiation significantly below a visible glow radiation emitted by said heating source.

20. The heater according to claim 2, wherein transverse to said conductor plane (39) said heating conductor (15, 16) and said compensation section (33) define cross-sectional width extensions, said width extensions being substantially equal, said compensation section (33) being made from a material thicker than said heating conductor.

21. The heater according to claim 2, wherein from said center axis (10) a center line of said compensation section (33) has at least one of varying spacings, and substantially constant spacings.

22. The heater according to claim 2, wherein said compensation section (33) is located closer to said center axis (10) than said outermost heating section.

23. The heater according to claim 2 and defining an axial plane (44) of said center axis (10), wherein said compensation section (33) is oriented substantially parallel to said axial plane (44).

24. The heater according to claim 1, wherein said heating conductor (15, 16) includes first and second heating conductors (15, 16), said heating field including first and second heating fields (12, 13) said supply conductor (22) for supplying said first heating conductor (15) extending from said second heating field (13) to said first heating conductor (15) and including a compensation section (33).

25. The heater according to claim 2, wherein a connector including at the most two connecting bodies (23, 24) is provided for connecting said heating source with appliance supply lines, said connector including at the most three connecting elements (25–27) directly connected to said operational conductors (16, 21, 22).

26. The heater according to claim 24, wherein a connecting element (27) is provided for directly and commonly connecting said second heating conductor (16) and said supply conductor (22) of said first heating conductor to an appliance supply line.

27. The heater according to claim 1, wherein said heating field (12, 13 or 12*d*, 13*d*) is bounded by a shield (6, 7 or 6*d*, 7*d*) projecting over said front side (11), in plan view said supply conductor (21, 22 or 21*d*, 22*d*) traversing said shield.

28. The heater according to claim 27, wherein said shield (6, 7 or 6*d*, 7*d*) covers said supply conductor (21, 22 or 21*d*, 22*d*), said shield including a separate shield body made in one part and layed on said supply conductor.

29. The heater according to claim 1, wherein at least one of said connecting points (17–20) and said connecting ends (29–32) is connected with connecting cheeks (51, 52 or 51*a*, 52*a* or 51*b*, 52*b*) spacedly opposing each other.

30. The heater according to claim 29, wherein a connecting element is provided, said connecting element being U-shaped and providing U-legs including said connecting cheeks.

31. The heater according to claim 30, wherein at least one of said connecting cheeks is made in one part with said operational conductor (21).

* * * * *